US006561959B2

(12) United States Patent
Batiste

(10) Patent No.: US 6,561,959 B2
(45) Date of Patent: May 13, 2003

(54) UPPER BODY EXERCISING APPARATUS

(76) Inventor: Stan Batiste, 9348 Buckhaven Dr., Las Vegas, NV (US) 89117

( * ) Notice: Subject to any disclaimer, the term of this patent is extended or adjusted under 35 U.S.C. 154(b) by 98 days.

(21) Appl. No.: 09/839,942

(22) Filed: Apr. 20, 2001

(65) Prior Publication Data

US 2002/0155931 A1 Oct. 24, 2002

(51) Int. Cl.[7] ..... A63B 21/02; A63B 21/015
(52) U.S. Cl. ..... 482/126; 482/118; 482/44
(58) Field of Search ..... 482/121, 44, 907, 482/126, 127, 46, 45, 49, 122, 118

(56) References Cited

U.S. PATENT DOCUMENTS

| | | | | |
|---|---|---|---|---|
| 2,529,347 A | | 11/1950 | Mohler et al. | |
| 2,806,699 A | | 9/1957 | Spooner | |
| 4,023,796 A | | 5/1977 | Kusmer | 272/137 |
| D253,903 S | | 1/1980 | Gibson | D21/198 |
| 4,483,533 A | | 11/1984 | Mangiapane | 272/137 |
| D277,593 S | | 2/1985 | Terrian et al. | D21/198 |
| 4,753,434 A | | 6/1988 | Salvino | 272/68 |
| 4,852,873 A | | 8/1989 | O'Donnell et al. | 272/137 |
| 5,413,548 A | * | 5/1995 | Hoffman | 482/127 |
| 5,536,223 A | * | 7/1996 | Ferber | 482/46 |
| 6,364,816 B1 | * | 4/2002 | Tang et al. | 482/126 |
| 6,436,017 B1 | * | 8/2002 | Chen | 482/121 |

* cited by examiner

*Primary Examiner*—Stephen R. Crow
(74) *Attorney, Agent, or Firm*—Sturm & Fix LLP

(57) ABSTRACT

An upper body exercising apparatus 10 including a first 12 and second 13 housing unit mounted for rotation relative to one another and including elongated arm members 22 and 33 wherein the housing units 12 and 13 are further provided with a chain drive unit 14 and an adjustable tension unit 15 for selectively positioning the first 12 and second 13 housing units relative to one another, and for varying the resistance to displacement from the selected position of the housing units 12 13.

4 Claims, 4 Drawing Sheets

UPPER BODY EXERCISING APPARATUS

CROSS REFERENCE TO RELATED APPLICATIONS

Not applicable.

BACKGROUND OF THE INVENTION

1. Field of the Invention

The present invention relates to the field of exercise equipment in general and in particular to an adjustable resistance upper body exercising apparatus.

2. Description of Related Art

As can be seen by reference to the following U.S. Pat. Nos. 4,483,533; 4,852,873; 4,753,434; and, 4,023,796, the prior art is replete with myriad and diverse upper body exercise apparatus which employ elongated arms.

While all of the aforementioned prior art constructions are more than adequate for the basic purpose and function for which they have been specifically designed, they are uniformly deficient with regard to not only the viability of the resistance provided by the apparatus; but also the lack of adjustability of the apparatus to allow a wide variety of upper body exercises to be performed by the user.

Up until the present time, upper body exercise apparatus only allowed a limited range of exercises to be performed due to the relatively fixed position of conventional exercise apparatus.

As a consequence of the foregoing situation, there has existed a longstanding need among those individuals who are genuinely concerned about physical fitness for a new type of upper body exercise apparatus which provides not only for variable resistance but also a wide range of flexibility with regard to the initial positioning of the elongated arms of the apparatus; and, the provision of such a construction is a stated objective of the present invention.

BRIEF SUMMARY OF THE INVENTION

Briefly stated, the arm exercising apparatus that forms the basis of the present invention comprises in general a two piece housing unit containing a rotary chain drive unit operatively associated with an adjustable tension unit, wherein, the resistance provided by the exercising apparatus may be varied to accommodate different exercise techniques and skill levels.

As will be explained in greater detail further on in the specification, each part of the two piece housing unit is provided with an elongated arm member having a handle portion which is designed to be grasped by the user's hands during the course of the exercises.

In addition, each part of the two piece housing unit is adapted to rotate relative to the other part of the housing unit, wherein, the adjustable tension unit is employed to resist the relative rotation between the two parts of the housing unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 2:
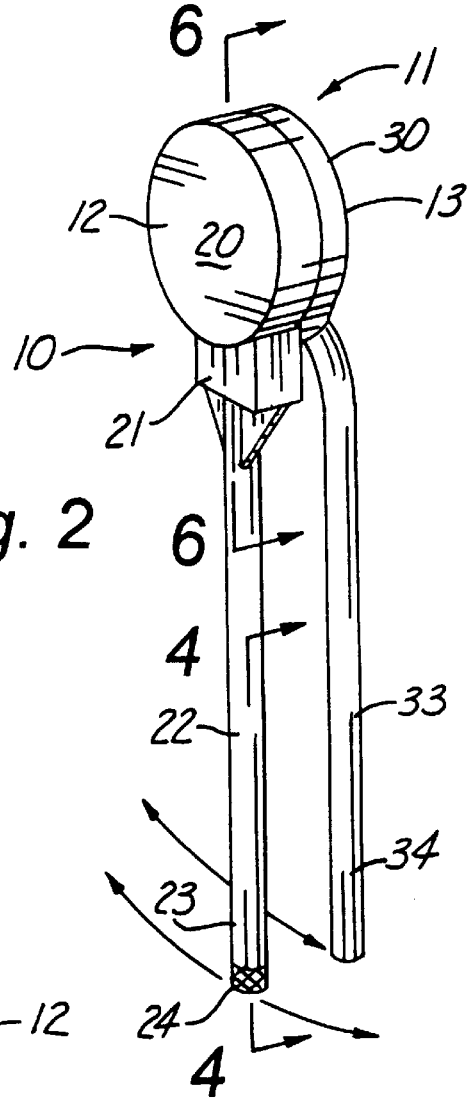
FIG. 2 is a rear perspective view of the apparatus in use.
Figure 4:
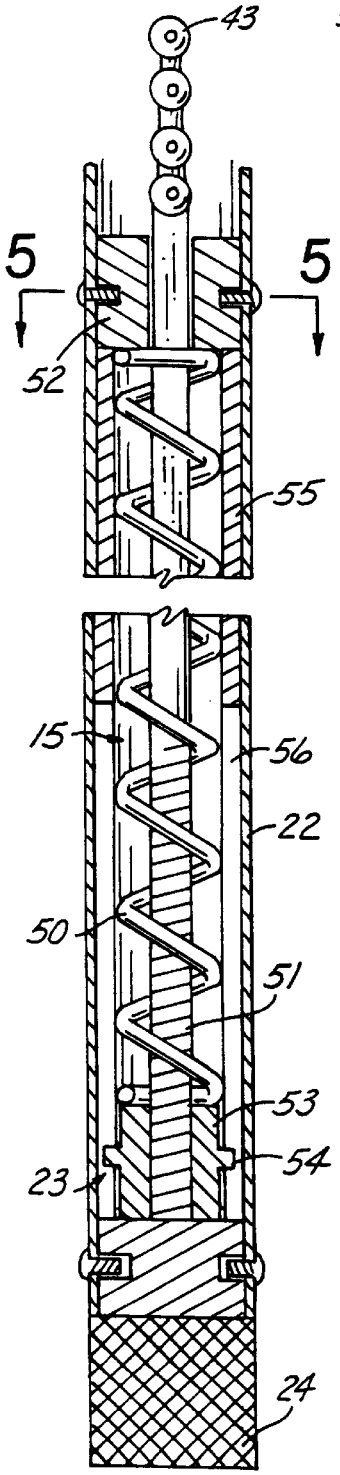
FIG. 4 is an isolated cross-sectional view of the spring tension adjustment unit of the apparatus taken through line 4—4 of FIG. 2.
Figure 5:
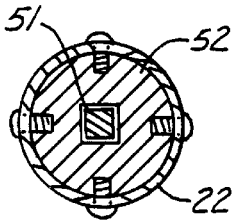
FIG. 5 is a cross-sectional view taken through line 5—5 of FIG. 4.
Figure 6:
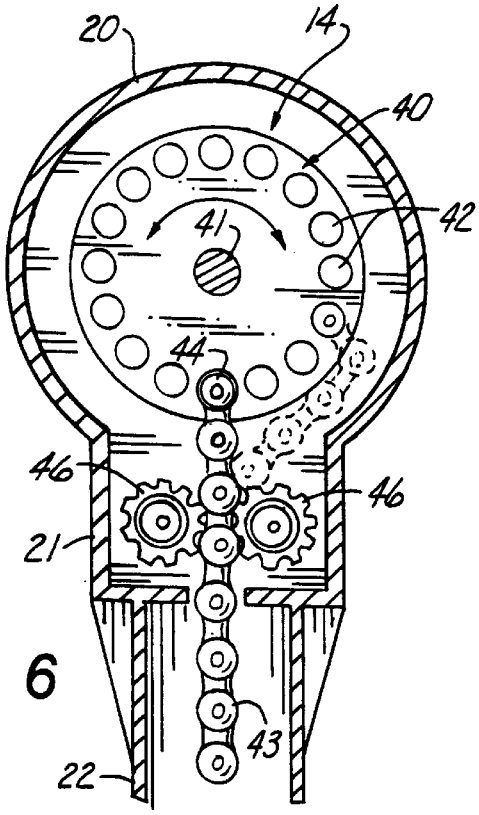
FIG. 6 is an isolated cross-sectional view of the chain and sprocket linkage unit taken through line 6—6 of FIG. 2.

As can be seen by reference to the drawings, and in particular to FIGS. 2, 4, and 6, the upper body exercising apparatus that forms the basis of the present invention is designated generally by the reference numeral 10. The apparatus 10 comprises in general a two piece elongated housing unit, including a first housing unit 12 and a second housing unit 13, wherein the housing unit 12 13 contains a rotary chain drive unit 14, a tension adjustment unit 15 and a position adjustment unit 16. These units will now be described in seriatim fashion.

As can best be seen by reference to FIGS. 2, 3, and 10 through 12, the first housing unit 12 of the two piece housing unit comprises a generally shallow cylindrical housing member 20 having a downwardly depending substantially enclosed rectangular extension element 21 formed integrally therewith, wherein the extension element 21 is further provided with a first generally straight hollow tubular arm member 22 which is radially aligned with the generally cylindrical upper housing member 20. In addition, the lower end of the first arm member 22 is provided with a handle portion 23 having a tension adjustment knob 24 whose purpose and function will be described in greater detail further on in the specification.

Turning now to FIGS. 2, 3, 8 and 10 through 12, it can be seen that the second housing unit 13 comprises a generally flat circular housing cover member 30 having an enlarged central opening 31 and a relatively discrete offset opening 32 formed therein, wherein the purpose and function of the openings 31 32 will be described in greater detail further on in the specification.

In addition, the housing cover member 30 is dimensioned to overlie the opening 25 of the cylindrical housing member 20 wherein, the lower portion of the housing member 30 is provided with a second tubular arm member 33 which is radially offset from the center of the cover member 30 such that when the first 12 and second 13 housing units are joined together as depicted in FIG. 2, the handle portions 23 and 34 of the first 12 and second 13 housing units are spaced from one another in a generally parallel relationship.

Turning now to FIGS. 6, 8, 10 and 11, it can be seen that the rotary chain drive unit 14 comprises a hub member 40 fixedly secured within the shallow cylindrical housing member 20, wherein the hub member 40 is provided with: an axial stem element 41 dimensioned to be received in the central opening 31 of the housing cover member 30, and a plurality of radially arrayed peripheral apertures 42. In addition, the chain dive unit 14 also includes an elongated force transmitting chain drive member 43 having connector links 44 45 formed on its opposite ends, wherein, one of the connector links 44 is operatively engaged in a selected one of the peripheral apertures 42 in the hub member 40, and the other of the connector links 45 is operatively engaged with a portion of the tension adjustment unit 15 as will be explained presently.

Figure 11:
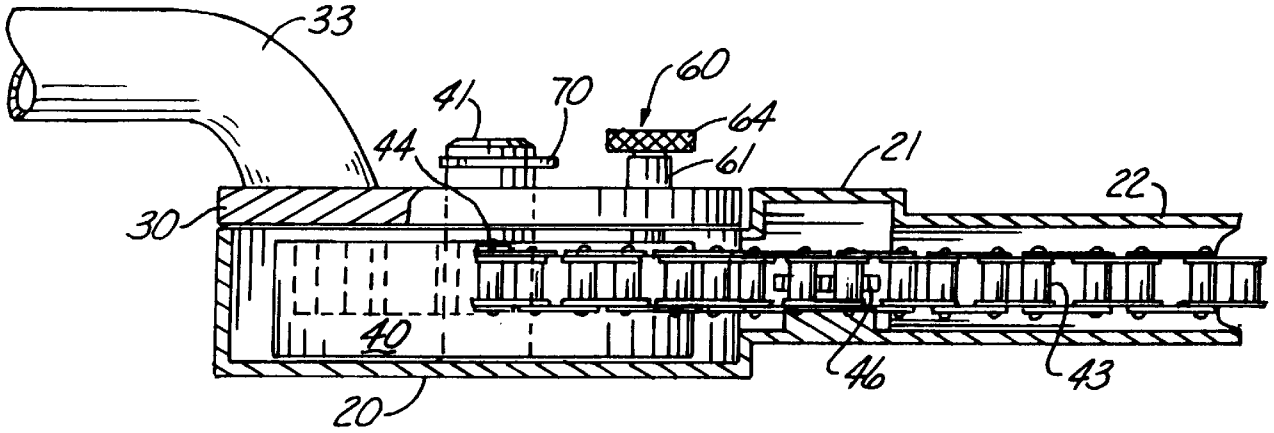
FIG. 11 is a cross-sectional view of the central housing unit and one of the arms of the exercise apparatus; and, FIG. 12 is an isolated view of the central housing member and the arm members of the exercise apparatus.
Figure 12:
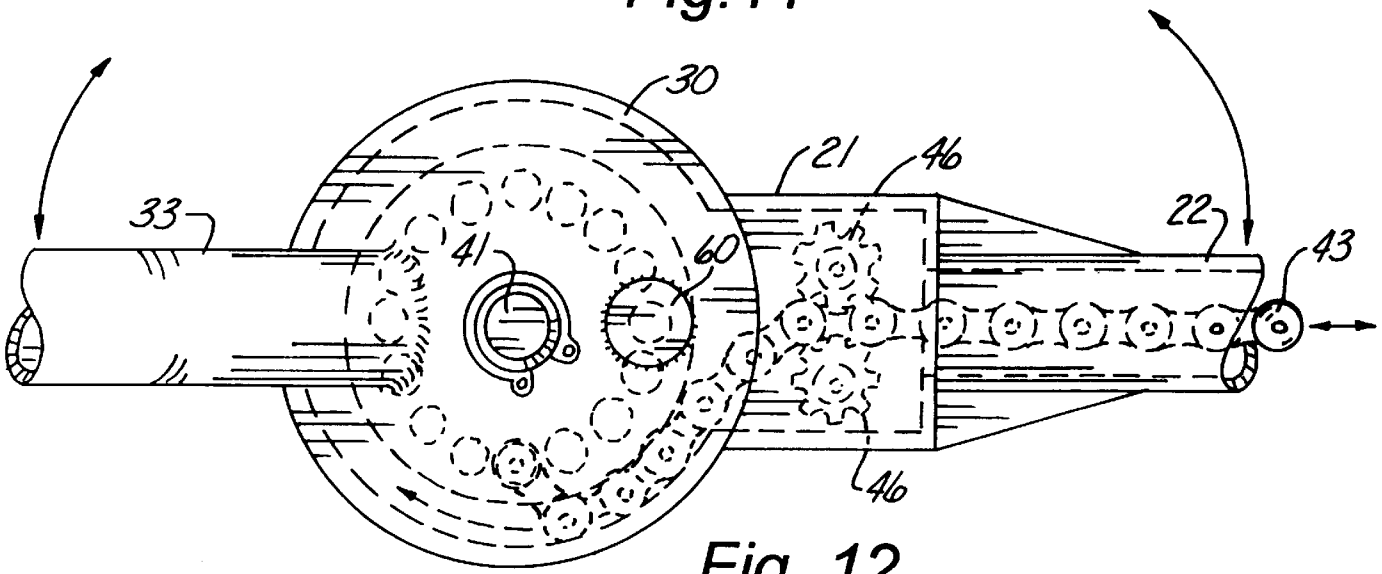

Furthermore, as shown in FIGS. 6, 11 and 12, the chain drive unit 14 further includes a pair of opposed sprocket elements 46 disposed within the housing extension element 21 and operatively engaged with the opposite sides of the intermediate portion of the chain drive member 43.

As can be seen in particular by reference to FIG. 4, the tension adjustment unit 15 comprises a helical spring member 50 disposed in a surrounding relationship relative to an elongated threaded member 51 wherein, one of the ends of the spring member 50 bears against a stationary bearing element 52 captively engaged in the handle portion 23 of the first arm member 22 and the other end of the spring member 50 which is operatively engaged with a moveable bearing element 53 threadedly engaged with said threaded member 51 and having a pair of outwardly projecting opposed ears 54 whose purpose and function will be explained presently.

Still referring to FIG. 4, it can be seen that the adjustment knob 24 in the handle portion of the first arm member 22 comprises the lower portion of an elongated hollow tubular element 55 which is rotatably disposed in the lower end of the first arm member 22. In addition, the elongated hollow tubular element 55 is further provided with a pair of elongated opposed slots 56 which are dimensioned to receive the ears 54 on the movable bearing element 53 to be vertically translated on the threaded member 51 to vary the tension of the spring member 50 in a well recognized fashion.

As shown in FIGS. 9 through 12, the position adjustment unit 16 also includes a retractable position adjustment member 60 disposed within a tubular sleeve 61 which is disposed in the discrete aperture 32 in the housing cover member 30. The tension adjustment member 60 includes an elongated plunger element 62 having one end which is dimensioned to be received in any one of the peripheral apertures 42 in the hub member 40 of the chain drive unit 14 so as to form the operative engagement between the first housing unit 12 and the second housing unit 13.

In addition, the other end of the plunger element 62 has a reduced diameter portion which is dimensioned to pass through a stepped shoulder opening formed on the outboard end of the tubular sleeve 61, and the outboard end of the plunger element 62 is provided with an enlarged head 64 for overcoming the spring bearing provided by the spring element 65 disposed between the stepped shoulder opening 63 of the tubular sleeve 61 and the rear surface of the plunger element 61.

As shown in FIGS. 8 through 11, the first housing unit 12 is connected to the second housing unit 13; by placing the axis stem 41 of the hub member 40 of the first housing unit 12 and then installing a locking ring 47 into the suitably dimensioned circumferential groove 48 formed on the outboard end of the axial stem 41.

At this juncture, the enlarged head 64 of the position adjustment member 60 is retracted to selectively position the plunger element 62 in one of the apertures 42 in the hub member 40 to preposition the starting position of the first housing unit 12 relative to the second housing unit 13. In the embodiment depicted in FIG. 1, the position adjustment member 60 has been retracted to allow the housing units to be deployed at an angle of 180 degrees with no tension being exerted by the spring member 50; and, in the embodiment of FIG. 2, the position adjustment member 60 has been retracted to allow the first and second housing units 12 and 13 to be deployed at an angle of 0 degrees with no tension being exerted by the spring member.

In this manner, the initial starting position of both of the housing units 12 and 13 may be selectively positioned from 0 degrees to 360 degrees to allow the user to employ the exercise apparatus 10 for a wide variety of exercises; and, at various tension resistance depending upon the position of the movable bearing element 53 within the first arm member 22 via manipulation of the tension adjustment knob 24.

Figure 3:
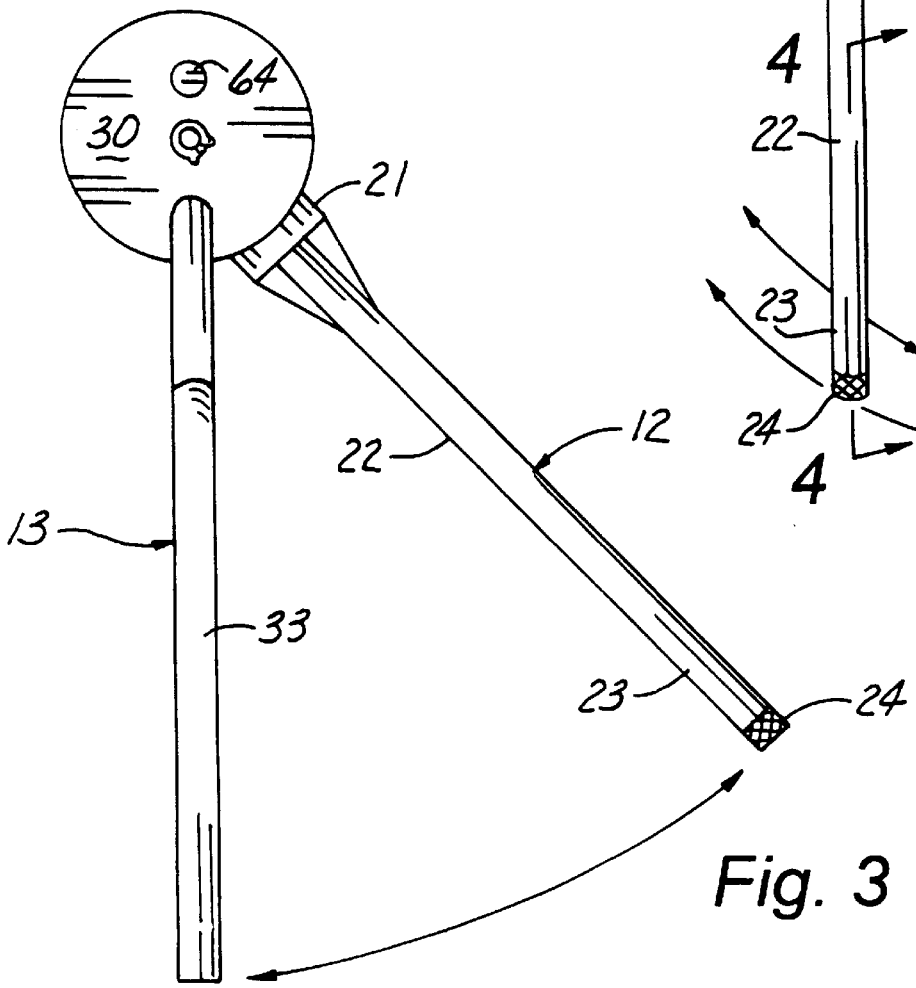
FIG. 3 is a front plan view of the apparatus.

At this juncture, it should be noted that the arms 22 and 33 of the apparatus 10 are offset from one another to allow passage of the arms in both directions relative to one another as indicated by the directional arrows in FIGS. 2 and 3.

Figure 1:
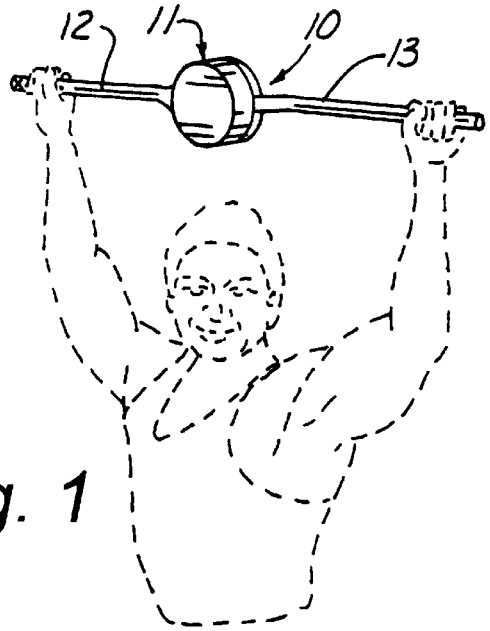
FIG. 1 is a perspective view of the apparatus in use.
Figure 7:
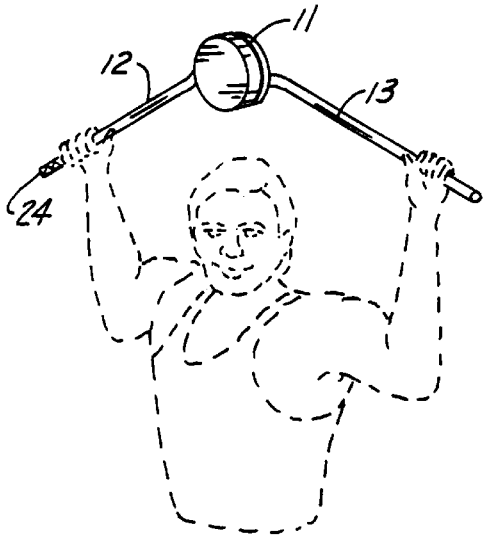
FIG. 7 is another perspective view of the apparatus in use.
Figure 8:
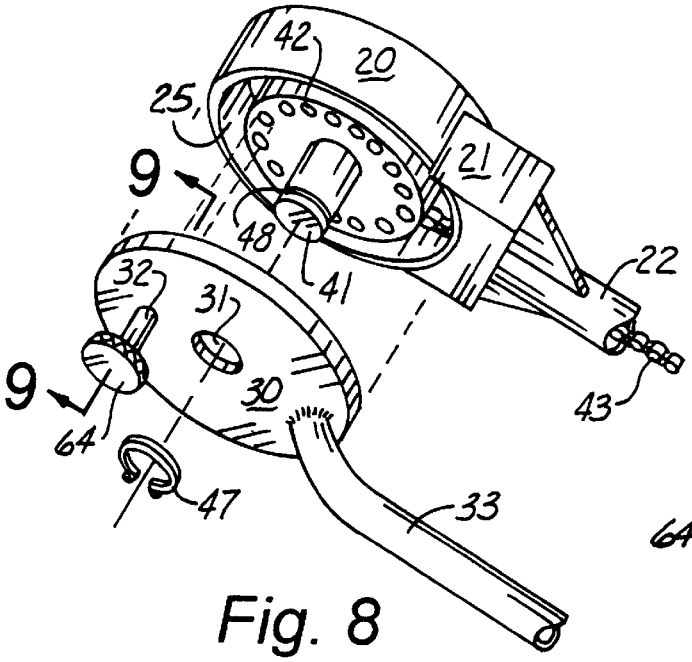
FIG. 8 is an exploded perspective showing our side of the central housing unit.
Figure 9:
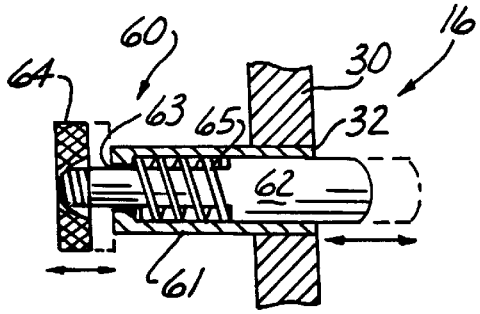
FIG. 9 is an isolated cross-sectional view taken through line 9—9 of FIG. 8.
Figure 10:
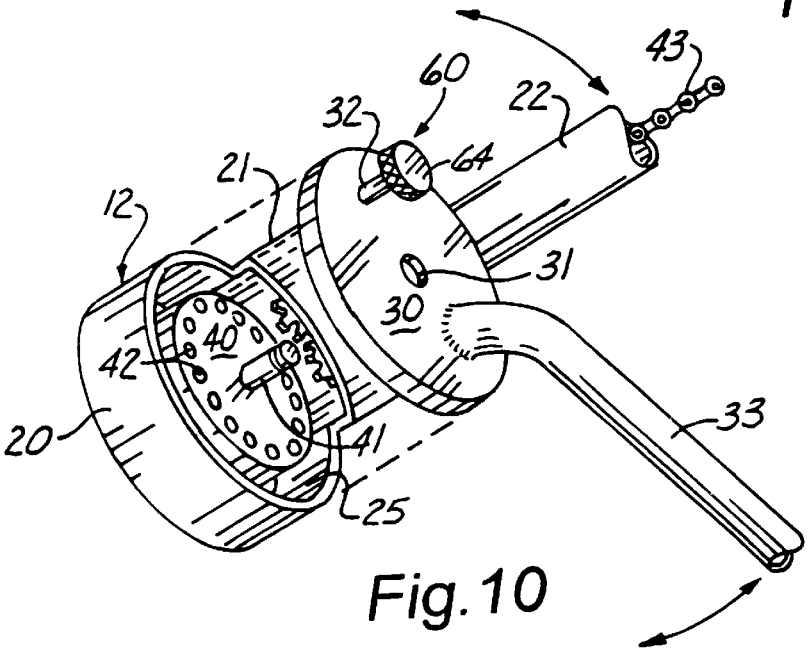
FIG. 10 is an exploded perspective view showing the other side of the central housing unit.

It should also be appreciated by reference to FIGS. 1 and 7, that the beginning position and resistance force provided by the exercise apparatus 10 may be varied by the selective manipulation of either or both of the tension and position adjustment knobs 24 and 64 to provide a wide range of exercise options for the user of the apparatus.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An upper body exercising apparatus comprising a first housing unit having a first elongated arm member;

a second housing unit rotatably disposed relative to said first housing unit and having a second elongated arm member;

first means for selectively positioning and operatively engaging said first housing unit relative to said second housing unit wherein, said first means comprises a retractable plunger element operatively disposed in the other of said housing units; wherein a hub member is provided with a plurality of apertures; and, each of said apertures is dimensioned to receive said retractable plunger element;

second means for resisting the displacement of said first housing unit relative to said second housing unit when said first and second housing units have been selectively positioned.

2. The exercise apparatus as in claim 1; wherein, said second means comprises an adjustable tension unit.

3. The exercise apparatus as in claim 1; wherein, said second means comprise a chain drive unit operatively attached on one end to said hub member and operatively engaged on the other end to a helical spring member.

4. The exercise apparatus as in claim 3 further including:

third means for varying the resistance of said helical spring to the displacement of said first housing unit relative to said second housing unit.

* * * * *